US006324884B1

(12) United States Patent
Barjesteh et al.

(10) Patent No.: US 6,324,884 B1
(45) Date of Patent: Dec. 4, 2001

(54) HAND-HELD PORTABLE CRIMPING TOOL

(75) Inventors: Michael Barjesteh, Denville, NJ (US); Nader Barjesteh, Woodbury, MN (US)

(73) Assignee: Mastercool, Inc., Randolph, NJ (US)

( * ) Notice: Subject to any disclaimer, the term of this patent is extended or adjusted under 35 U.S.C. 154(b) by 0 days.

(21) Appl. No.: 09/696,516

(22) Filed: Oct. 25, 2000

Related U.S. Application Data

(63) Continuation-in-part of application No. 09/608,942, filed on Jun. 30, 2000.

(51) Int. Cl.[7] ..... B21D 41/04
(52) U.S. Cl. ..... 72/402; 72/453.16; 29/237
(58) Field of Search ..... 72/402, 416, 453.16, 72/453.15, 412, 470; 29/237

(56) References Cited

U.S. PATENT DOCUMENTS

| | | | | |
|---|---|---|---|---|
| 3,575,036 | * | 4/1971 | Hoffman | 72/402 |
| 3,771,343 | * | 11/1973 | Dawson | 72/402 |
| 3,823,597 | * | 7/1974 | Hanback | 72/402 |
| 3,848,451 | * | 11/1974 | Allin | 72/402 |
| 4,192,171 | | 3/1980 | Hamilton | 72/416 |
| 4,261,194 | * | 4/1981 | Stephens | 72/402 |
| 5,257,525 | | 11/1993 | Clarke | 72/402 |
| 5,335,530 | * | 8/1994 | Homm | 72/402 |
| 5,353,623 | | 10/1994 | Bobenhausen | 72/402 |
| 5,481,893 | | 1/1996 | Barjasteh et al. | 72/107 |
| 5,720,197 | * | 2/1998 | Grau | 72/402 |
| 5,782,128 | | 7/1998 | Barjasteh et al. | 72/318 |

FOREIGN PATENT DOCUMENTS

| | | | | |
|---|---|---|---|---|
| 1452970 | * | 8/1970 | (DE) | 72/402 |

* cited by examiner

*Primary Examiner*—Daniel C. Crane
(74) *Attorney, Agent, or Firm*—Mathews, Collins, Shepherd & Gould

(57) ABSTRACT

A hand-held portable crimping tool for crimping fittings to hose assemblies, is manually operable, has removable snap-in dies, and yoke that is hydraulically powered. Operation of the tool causes the snap-in dies to crimp the fitting, wherein a linear force is transformed into a non-linear force applied by the snap-in dies to the fitting.

13 Claims, 9 Drawing Sheets

HAND-HELD PORTABLE CRIMPING TOOL

RELATED APPLICATIONS

This application is a continuation in part of co-pending U.S. patent application Ser. No. 09/608,942, entitled Hand-held Apparatus For Crimping, filed on Jun. 30, 2000.

FIELD OF THE INVENTION

This invention relates to a manually operable, portable, hydraulically powered, apparatus for crimping fittings to hose assemblies.

BACKGROUND OF THE INVENTION

Conventional refrigeration systems circulate a refrigerant through a closed cooling system. In this circulation process, the refrigerant changes states between a fluid and a gas. Freon has been used as a refrigerant. Freon consists of dichlorofluorocarbons, such as dichlorodifluoromethane. Conventional freon is designated under ANSI Code B79.1-1968 as Freon 12, R-12 or Genetron 12. It has been found that the release of halogen refrigerants into the atmosphere deleteriously affects the ozone layer, which surrounds and protects the earth from ultraviolet solar radiation.

The United States Environmental Protection Agency mandated the use of a refrigerant described as R-134*a* systems or HCF 134 systems to minimize ozone depletion. The R-134 refrigerant system replaces the dichoride in the refrigerant with hydrogen for minimizing the release of halogens into the atmosphere. Although the R-134 refrigerant is less harmful than freon to the environment, the EPA still recommends that the R-134 refrigerant should not be released to the atmosphere. The R-134 refrigerant is typically recycled by a closed system, which is defined as a "refrigerant recycling machine."

Conventional fittings, adapters or couplers have been used for connecting and disconnecting refrigerant recycling machines to the tubular high or low-sides of air conditioning systems. Conventional hoses, couplers and ports have been used with R-12 refrigerant systems. Recently, the Society of Automotive Engineers (SAE), Environmental Protection Agency (EPA) and Automotive manufacturers mandated the retrofitting of all the hoses and fitting from the R-12 standards to the R-134*a* standards. This requires performing hose make-up or repair on hose assemblies for R-134*a* systems.

Crimping devices have been used to crimp a fitting onto a hose. U.S. Pat. Nos. 4,192,171, 5,353,623, 5,481,893, 5,257,525 describe representative hand held crimping tool. U.S. Pat. No. 5,782,128 describes a hydraulically powered hand tool for creating a radially outward flare away from the end of the tube. This hand tool has a manually powered hydraulic pump that is used as a repair apparatus for connecting a fluid line to a hose or a different conduit.

There is a need for a versatile hand tool with easily replaceable dies and yoke, which is also hydraulically powered for crimping a fitting to hose assemblies. The present invention provides a sealing and crimping locking device for retrofitting refrigeration systems and preventing leakage of refrigerant from cooling systems.

SUMMARY OF THE INVENTION

The present invention is a hand-held portable crimping tool for crimping fittings to hose assemblies. The hand-held portable crimping tool is manually operable, has removable snap-in dies, and yoke that is hydraulically powered. Operation of the tool causes the snap-in dies to crimp the fitting, wherein a linear force is transformed into a non-linear force applied by the snap-in dies to the fitting.

BRIEF DESCRIPTION OF THE DRAWINGS

A more complete understanding of the present invention may be obtained from consideration of the following description in conjunction with the drawings in which.

DETAILED DESCRIPTION

Figure 1:
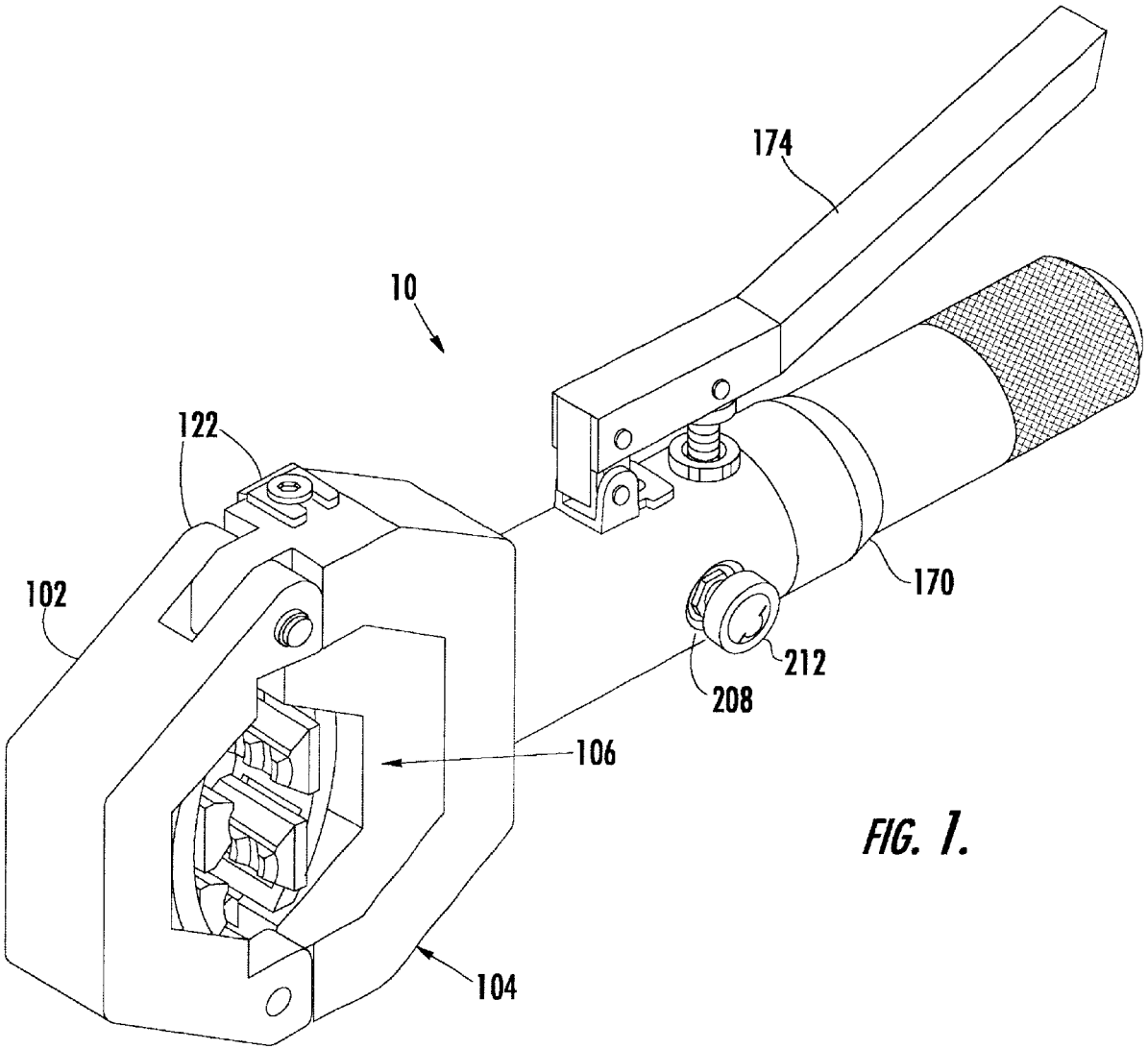
FIG. 1 is a side elevational view of the crimping apparatus.

Although the present invention, hand-held portable crimping tool, is particularly well suited for use with refrigeration hoses and shall be so described, the present invention is equally well suited for other types of pressurized hoses.

During the course of the description like members will be used to identify like elements according to the different figures, which illustrate the invention.

Referring now to the drawings the exemplary embodiment of the invention as disclosed in FIGS. 1–8 illustrates the hand-held portable crimping tool 10 in accordance with the teachings of the present invention. The frontal side of all embodiments described in this invention refers to the left side of FIG. 1 and the rear side of all members refers to the right side of FIG. 1.

Figure 2:
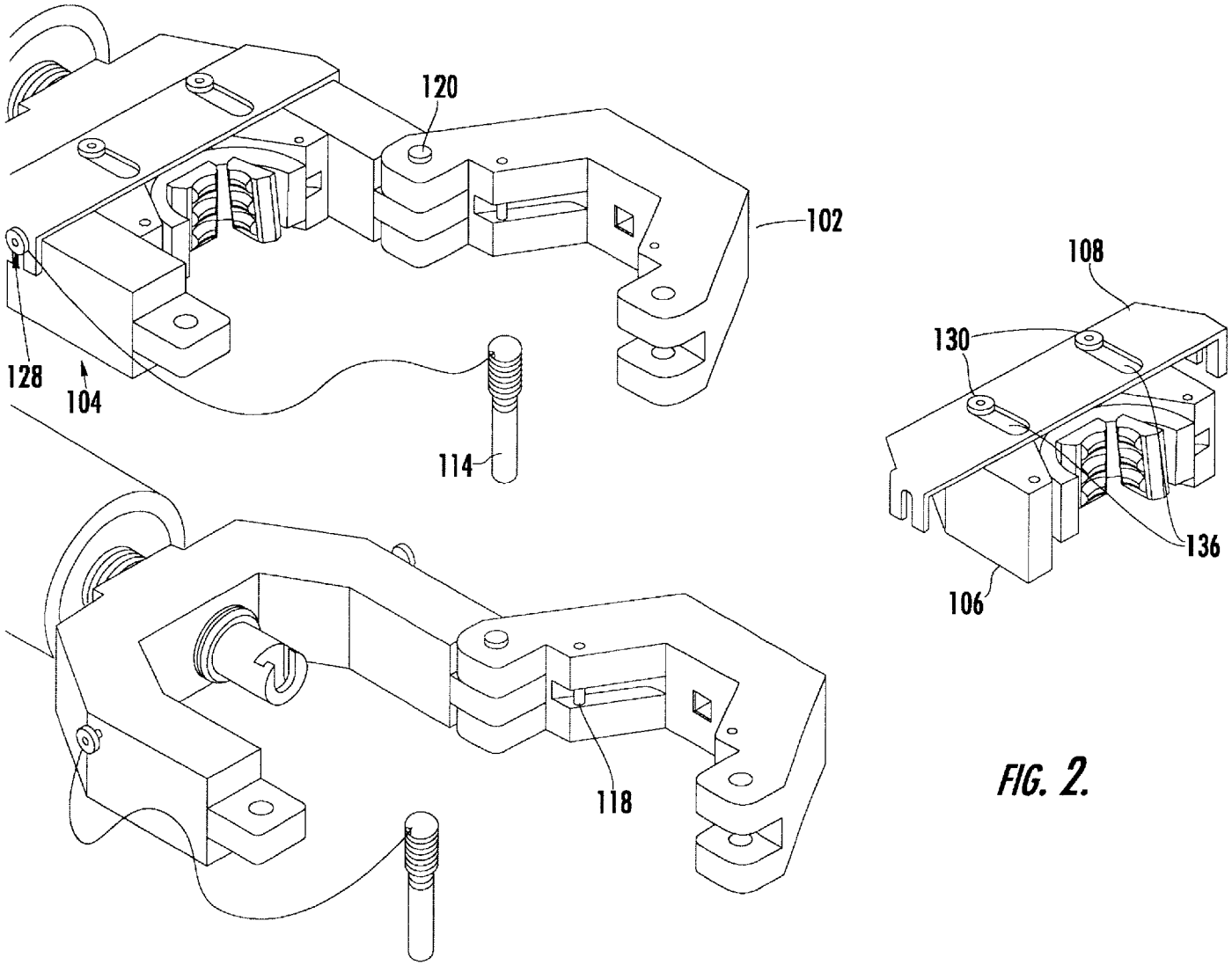
FIG. 2 is a top view of the yoke, bottom die holder and crimping dies.

Referring to FIG. 1 a hand-crimping apparatus 10 has generally a yoke 122 for holding crimping dies 110 and a hydraulic pump portion 170. Additionally, the hand-crimping apparatus further comprises a relief valve 208 and a lever arm 174 for applying pressure to crimp fittings to hose. Preferably, yoke 122 comprises a bottom yoke 104 and a top yoke 102. Bottom 104 and top yoke 102 are preferably attached to one another by fixed pin 120 and a removable holding pin 114 as shown in FIG. 2. Other means for coupling bottom yoke 104 and top yoke 102 together may be used, such as a butt-type hinge and hasp combination, a snap action latch and hinge combination or two removable pins. In an alternative embodiment, a single c shaped pin 238 (FIG. 7) is used instead of fixed pin 120 and holding pin 114.

Figure 3:
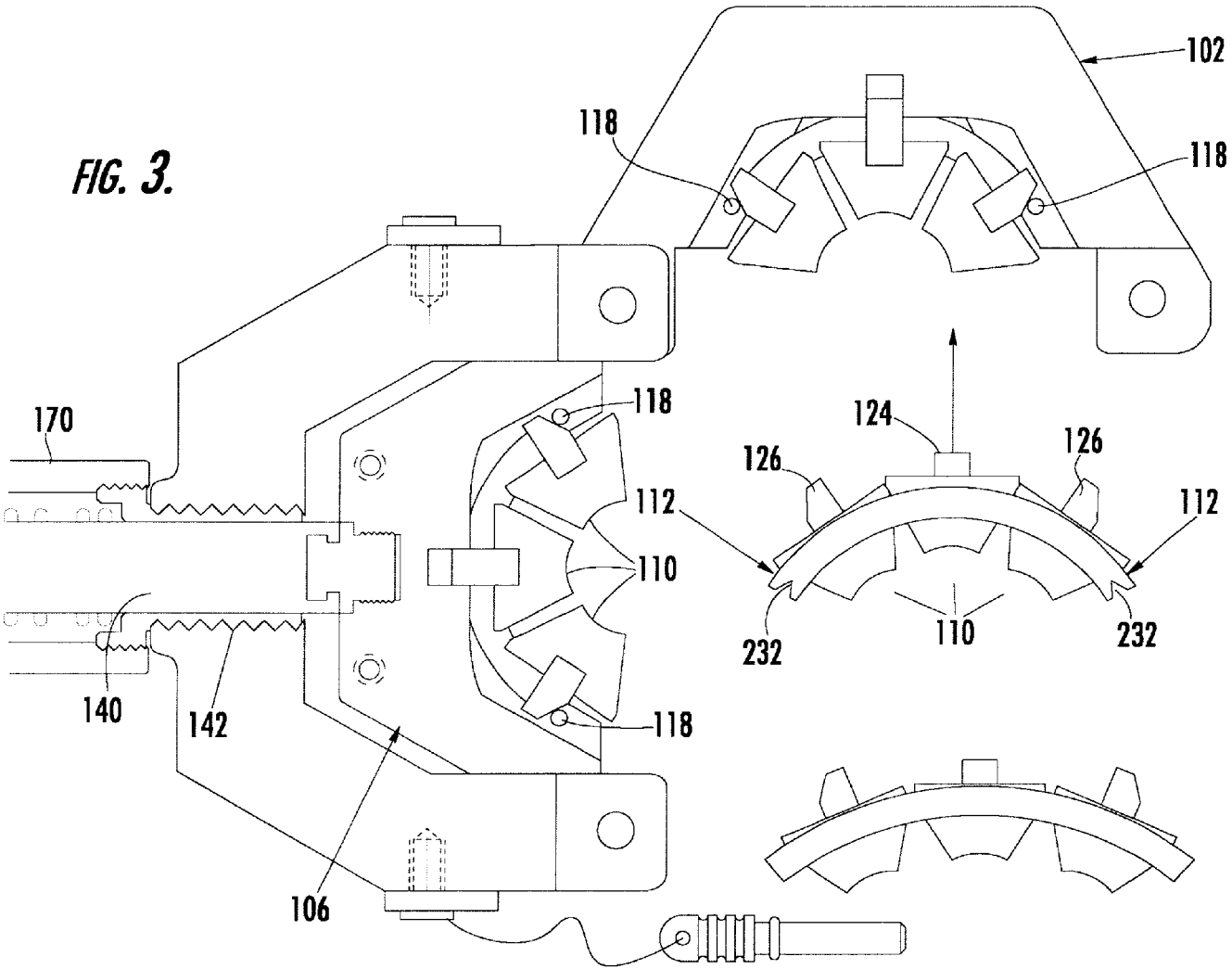
FIG. 3 is a side view of the crimping dies.

The yoke 122 is connected to the hydraulic pump portion 170. Preferably, aperture 138 of bottom yoke 104 is internally threaded and is connected to post 128 protruding from hydraulic pump portion 170 that is externally threaded as shown in FIG. 3. A variety of yokes known to those skilled in the art can be utilized in the present invention. For example, but not limited to, the yoke 122 comprises two pieces, a top yoke 102 and a bottom yoke 104. In other embodiments of the present invention, the yoke comprises three or four hinged sections. Various designs of yokes to hold the dies are known to those skilled in the art, and can be used in the present invention.

The holding plate 108 fixes to bottom yoke 104 and entire hydraulic pump portion 170. Screws 128 fix holding plate 108 to bottom yoke 104. Guide screws 130, hold bottom die holder 106 to holding plate 108. Holding plate 108 has elongated holes 136, through which guide screws 130 are fastened, and allow bottom die holder 106 to move with the crimping piston 140. Guide screws 130 are not tightened down to allow bottom die holder 106 to move. The holding plate 108 is removable and allows for different yoke and die configurations to be attached to hydraulic pump portion of tool by guide notch 220.

Both bottom die holder 106 and top yoke 102 have guide pins 118 that hold crimping dies 110 into place. Each set of dies 110 has two outside feet 124 and one guide foot 126 that are held in position by the guide pins 118. When placing the dies 110 into place, the dies are squeezed together and guide foot 126 is placed in respective guide hole 134 in bottom die holder 106 or top yoke 102. When die 110 is released, the die opens and the outside feet 124 are held in place by the guide pins 118. (See FIG. 8).

The top yoke 102 rotates about fixed pin 120, which is held in place by snap ring 122. When crimping, top yoke 102 is fixed to bottom yoke 104 by holding pin 114. O-ring 116 on holding pin 114 helps hold the holding pin 114 in place.

In the present invention. the crimping dies 110 easily snap into and out of the top yoke 102 and bottom die holder 106 by means of die locators 112, which has openings whereby the die locators 112 hold the crimping dies 110 by the guide foot 126 and outside feet 124 which fit through the openings. The die locators 112 allow for easy snap in and removal of the crimping dies. In a preferred embodiment, the die locators 112 are made of an elastomeric material, for example but not limited to a plastic, and allow for the engagement of the crimping dies into the bottom die holder 106 and top yoke 102.

The crimping dies 110 are located initially, before crimping, by die locators 112. The die locators 112, are made in various configurations, slots 232 (FIGS. 3,7 and 8), cutouts 234 (FIGS. 7 and 8), etc. between the crimping dies 110, in order to change the movement (response) of the crimping dies 110 when they are placed under crimping pressure. In an additional embodiment, the die locators 112 may be made of a composite of layers and zones of material providing a tailored response to the applied linear clamping force of the bottom die holder 104. In yet a further embodiment, guide foot 126 is designed with a suitable shape and made from a resilient material, so that when the crimping force is applied, the guide foot moves into the respective guide hole 134 in order to change the movement (response) of the crimping dies 110 when they are placed under crimping pressure. Each size (set) of crimping dies 110 requires different forces to position them correctly in order to exert uniform pressure on the fitting being crimped so as to form a uniformly round crimp. Without controlling the crimping force, the crimping dies 110 will apply essentially a linear/vice like force, partially deforming the fitting, until the crimping dies 110 are adequately closed, thus providing an inferior crimp seal. By controlling and adjusting the crimping force applied by the crimping dies 110, the crimping seal is more uniform and does not deform (squash) the fitting. This improves the reliability of the crimping seal and thus the repair. The present invention thus provides a controlled and adjusted crimping force to the crimping dies 110 wherein a linear/vice like force is transformed into a non-linear crimping force at the crimping dies 110. The non-linear crimping force may be radial, or adjusted to correspond to an optimal crimping force for a particular fitting.

In one embodiment, there are at least two sets of crimping dies 110. In a preferred embodiment there are at least two sets of dies comprising six crimping dies (three dies per set). The number of crimping dies used can be varied. For example, two dies at a minimum are used, but any greater number of dies can be used depending upon the crimping pattern or design that is desired or required. Those skilled in the art of such devices would be able to modify the number of dies accordingly. For example, the number of dies can be, but not limited to, two, four, six or eight dies.

In the present invention, a variety of crimping dies 110 can be used. In another embodiment of the present invention, the dies have a design on their surface, whereby the design is transferred to the surface of the hose upon crimping. Additionally, dies having a design parallel to the axis of the hose, or radially to the axis of the hose can be used. Further, the design on the dies can be at any angle between parallel or radially to the hose. As described below, a most preferred embodiment the crimping dies 110 have one guide foot 126 and two outside feet 126.

In a preferred embodiment, the hydraulic force is transferred to the dies 110 and bottom die holder 106 by a crimping piston 140. FIG. 3. Other methods of transferring hydraulic power known or to be known to those skilled in the art can be used. The present invention utilizes a portable hydraulic pump portion 170 for providing force to the crimping dies 110 to cause the hose to crimp. It will be appreciated that any portable hydraulic device known or to be known to those skilled in the art can be utilized in the present invention.

Figure 4:
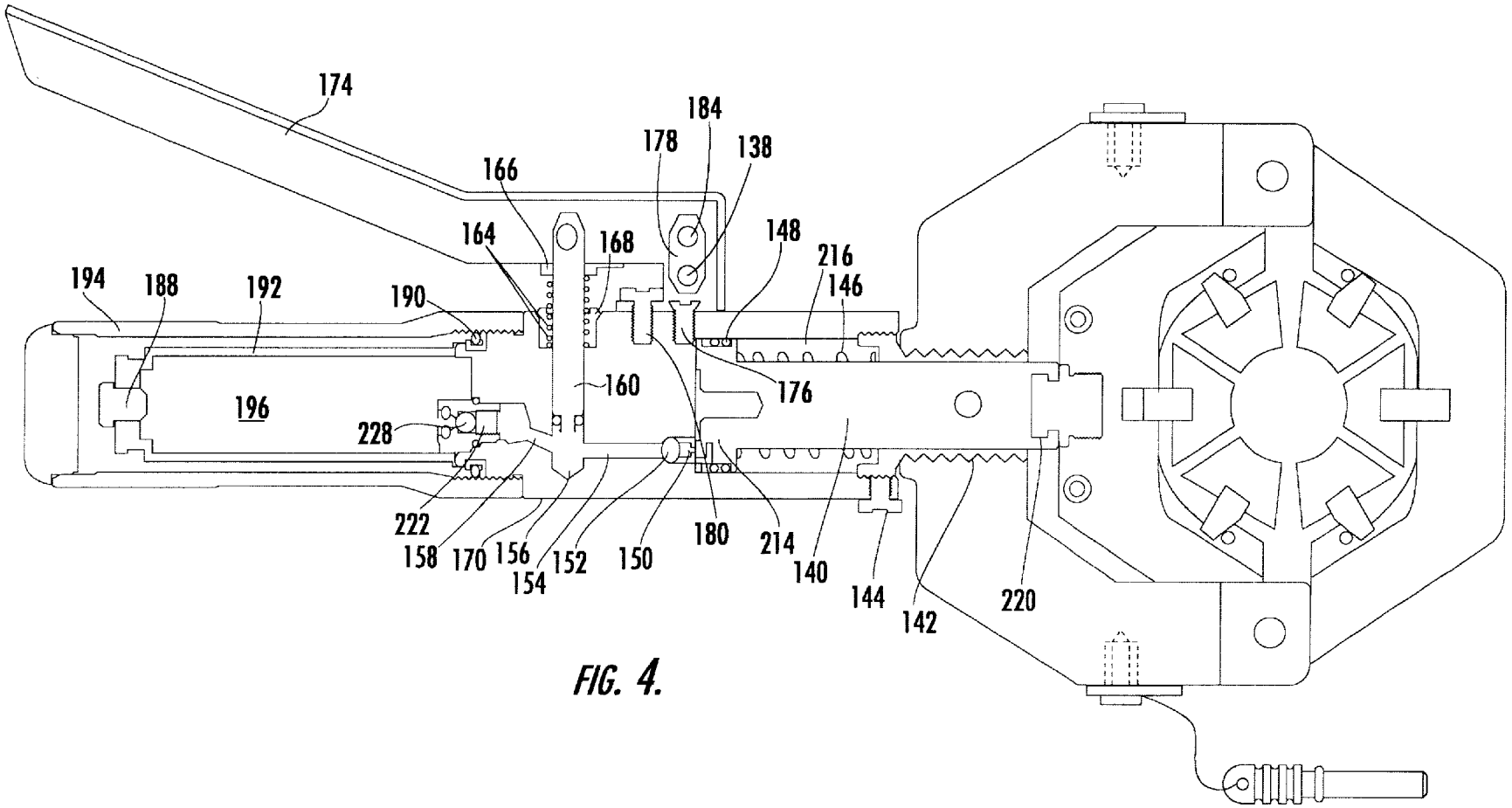
FIG. 4 is a side cross-sectional view of the crimping apparatus.

In a preferred embodiment of the present invention, the hydraulic pump portion 170 comprises positioning screw 142 that is a cylindrical tube having its outer surface threaded, as shown in FIGS. 3 and 4. As further shown in FIG. 4 positioning screw 142 is fixed to the body of 170 by one set screw 144. Crimping piston 142 is a solid cylindrical rod with guide notch 220 at its distal end and piston member that is a larger diameter disk 214 at the other end. The disk 214 has two O-rings 148 and a nylon ring and is placed in frontal pressurized cylinder 216. Spring 146 applies a bias compression force to the crimping piston 140 and disk 214 that is partially counteracting the oil pressure in the pressurized cylinder region 216. Spring 146 returns piston 140 when pressure in cylinder.

Further, the hydraulic pump portion 170 also has cylindrical passages 154, 156 and 158 that connect oil reservoir 196 to frontal pressurized cylinder 216. Spring 150 compresses spherical ball 152 against the opening of passage 154. The diameter of the opening of passage 154 is smaller that the diameter of ball 152 thus the compressive force of spring 150 keeps ball 152 at the opening of passage 154 thereby closing the opening. Setscrew adjusts the compressive force of spring 150 to ball 152. To increase the compressive load of spring 150, set screw can be rotated clockwise using a screwdriver.

Figures 5A, 5B:
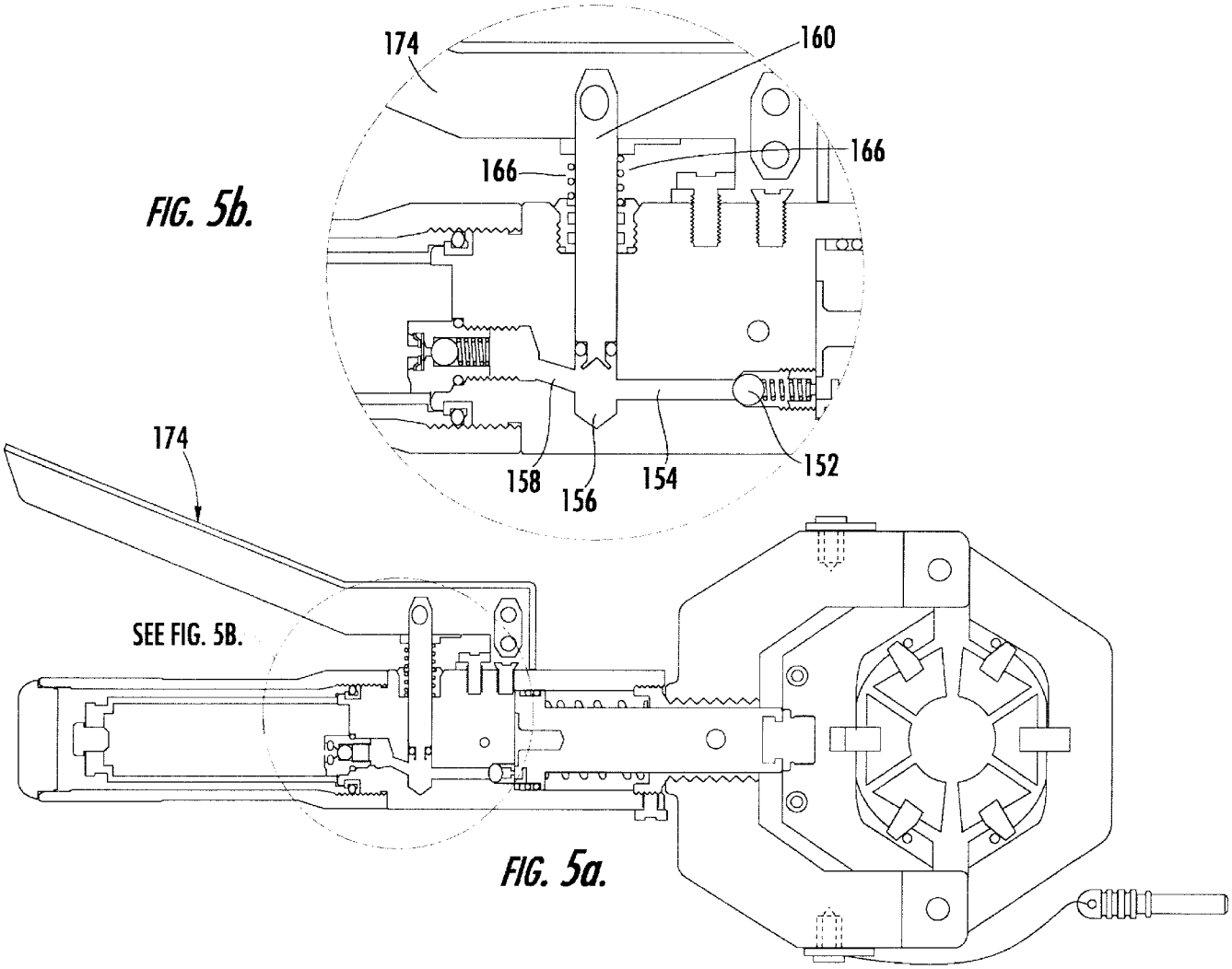
FIG. 5*a* is a side cross-sectional view of the handle of the hydraulic body.
FIGS. 5*b, c* and *d* are enlarged partial details of FIG. 5*a;*

As shown in FIGS. 4 and 5*a* and 5*b*, hydraulic pump portion 170 has a pumping linkage system consisting of piston 160, lever arm 174, linkage bar 178 and a support bracket 176. The oil is pumped from the reservoir 196 to frontal pressurized cylinder 216 by piston 160 and lever arm 174. Piston 160 is secured in passage 156 by cap screw 162 and is sealed by four O-rings 164. Spring 166 applies an upwardly compressive force to lever arm 174 through washer 168. The compressive force of spring 166 keeps lever arm 174 and hydraulic pump portion 170 separated and connects passages 158 and 156 by moving piston 160 upwardly. Lever arm 174 is hinged to linkage bar 178 by pin 184. Linkage bar 178 is hinged to support bracket 176 by pin 138. Support bracket 176 is rigidly attached to hydraulic pump 170 by screws 180 and 182, thus the whole pumping linkage system is stabilized. Stopper bar 186 that is attached to lever arm 174 limits the separation of lever arm 174 and hydraulic pump portion 170 as shown in FIG. 4.

Figures 5C, 5D:
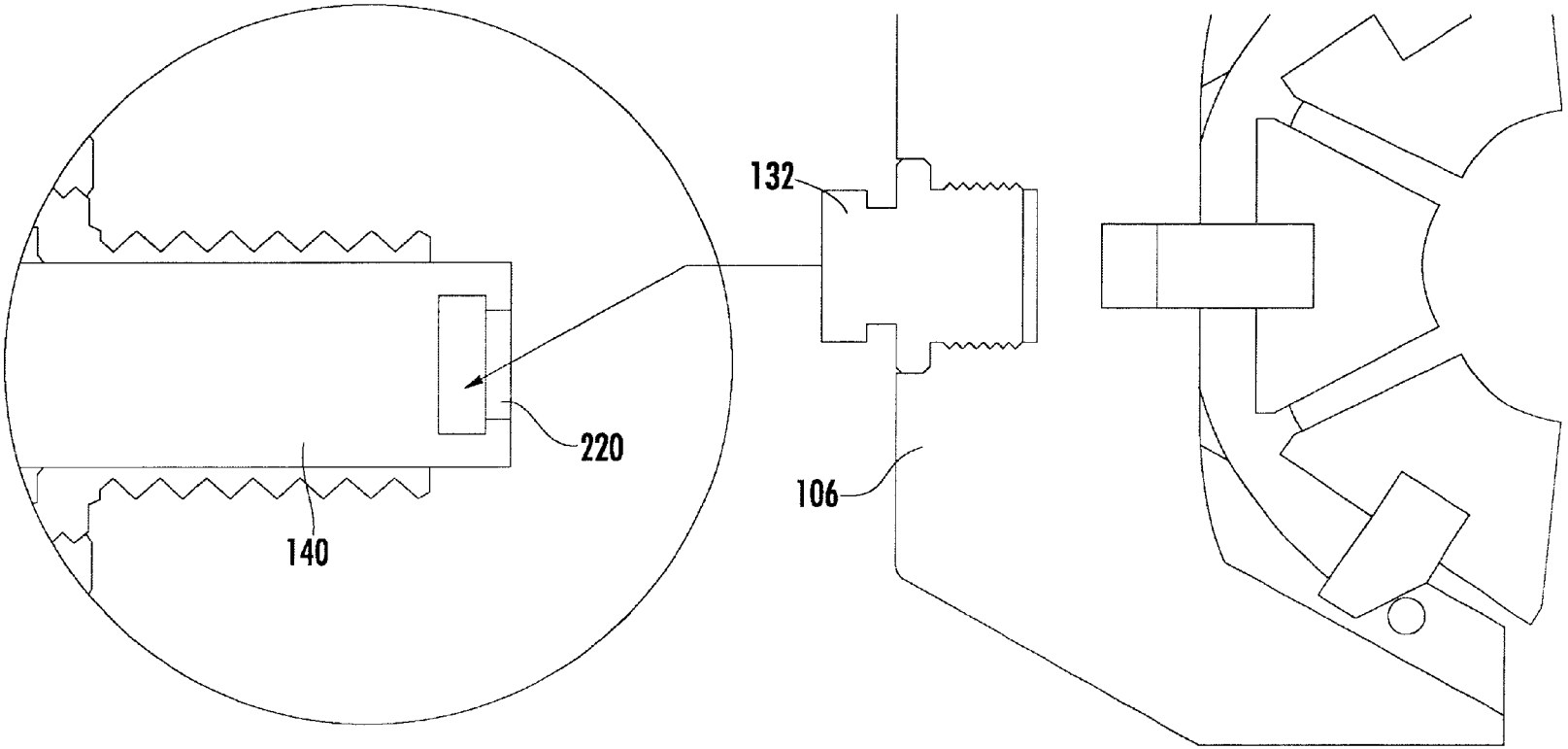

As further illustrated in FIGS. 4 and 5*c* and 5*d*, oil reservoir 196 is located in the rear embodiment of hydraulic pump portion 170 and is closed by capplug 188. Housing 194 screws onto the body of the hydraulic pump portion 170 and covers oil reservoir 196. Oil reservoir 196 is secured to hydraulic pump portion 170 by lip 228 (FIGS. 5*a* and 5*b*) on oil reservoir 196 that fits into mating lip 230 (FIGS. 5*a* and 5*b*) on hydraulic pump portion 170. O-ring 190 also helps secure oil reservoir 196 to hydraulic pump portion 170. To add or drain the oil in the reservoir 196 unscrew housing 194 and remove capplug 188.

In a free position of lever arm 174, spring 166 applies compressive force to washer 168 and pushes lever arm 174 away from hydraulic pump portion 170 as shown in FIG. 5*a* and 5*b*. The compressive force is counteracted by contacts that stopper 186 makes with support bracket 176. This is an upper limit position of lever arm 174. In this case, piston 160 is in its most upwardly position, and oil passages 156 and 158 are connected to oil reservoir 196. By pressing lever arm 174 downward towards hydraulic pump portion 170, spring 166 is compressed, piston 160 is pushed downward through cylindrical passage 156, thereby pressurizing the oil that is in passages 156 and 154. The pressurized oil in passages 154 and 156 is maintained by operation of a check valve 226, which comprises a spherical ball 152 and a spring 150. The pressure in passage 154 pushes spherical ball 152 away from the opening of passage 154, thus forcing oil to flow to frontal piston region 216. Once the oil has pressurized frontal piston pressurized cylinder 216, spring 150 applies the bias force to ball 152 and closes the opening of passage 154 and thus prevents the reverse flow of the oil from frontal pressurized cylinder 216 to reservoir 196. Therefore, after a few strokes of lever arm 174, frontal pressurized cylinder 216 is pressurized and through disk 214, crimping piston 140 applies an axially compressive force to bottom die holder 106.

In other embodiments of the present invention, the hydraulic pump portion 170 can be any compact and hand held potable hydraulic device known to those skilled in the art. In another preferred embodiment, the hydraulic body is a manually pumped hydraulic device. In yet another preferred embodiment, the hydraulic pump is an electrically powered hydraulic device. In still another preferred embodiment, the hydraulic body is a pneumatically operated hydraulic device.

In one embodiment of the invention the hydraulic pump portion comprises a body 194; an oil reservoir 196 attached to said body wherein the oil reservoir chamber is either vented or non-vented; a pressure source (such as a manual pump 174, a an electrical or pneumatically operated pressure source) that is attached to said body 194 wherein the pressure source is in fluid communication with the oil reservoir chamber; a pressure chamber 216 within said body wherein the pressure chamber comprises a piston capable of converting the hydraulic pressure to a linear force to the dies of the crimping apparatus for crimping a hose; and a securing member 142 to secure the hydraulic body to the yoke assembly. In preferred embodiments of the invention, the securing member 142 is a fixed length between the hydraulic body and the yoke assembly or the securing member is of an adjustable length so as to adjust the distance between the hydraulic body and the yoke assembly. FIGS. 3 and 4 show the adjustable securing member 142, which is threaded to allow adjustment in the distance between the hydraulic pump portion 170 and the yoke 122.

Figure 6:
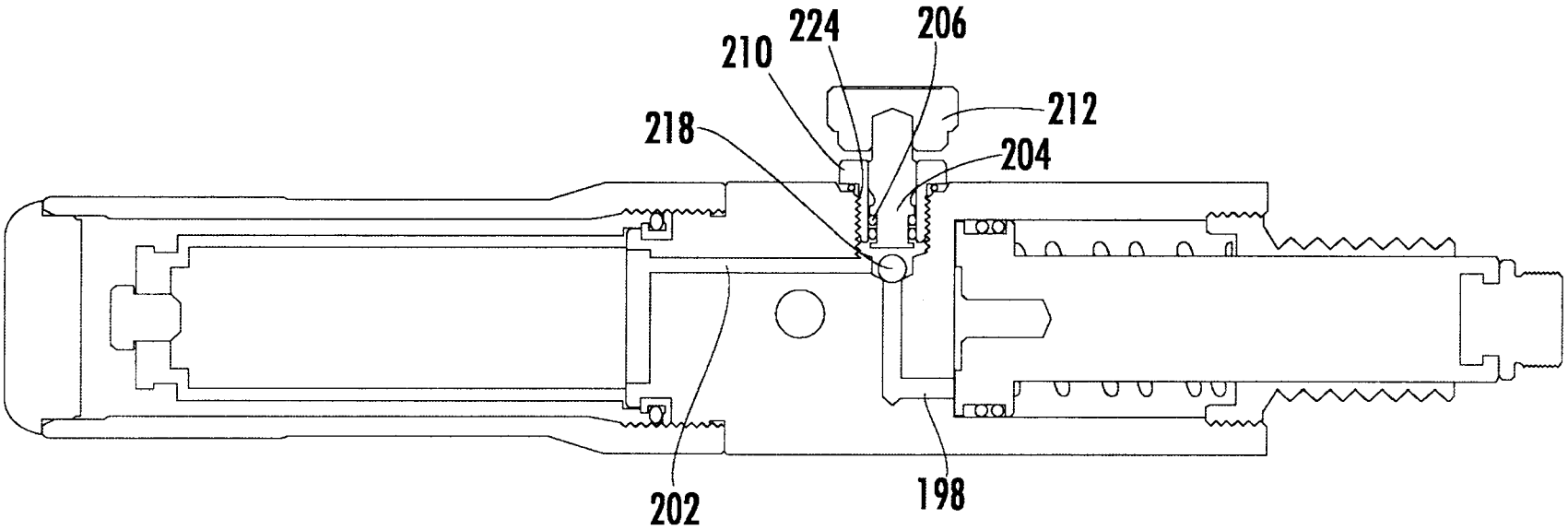
FIG. 6 is a side cross-sectional view of the relief valve.

In other embodiments. the hydraulic pump portion 170 further comprises at least one relief valve 208 for relieving pressure. In another embodiment, the hydraulic body further comprises at least one stop valve for 186 (as shown in FIG. 6) for preventing hydraulic fluid, under pressure, from returning to oil reservoir chamber 196. When stop valve 186 is closed pressure can be increased by pumping piston 160 (FIG. 5*a* and 5*b*). To retract piston 140 (FIG. 4), stop valve 186 (FIG. 6) must be open. In another embodiment of the invention, the relief valve 208 and the stop valve 186 are the same valve.

In a preferred embodiment, the crimping piston 140 is a shaft concentric and within the hydraulic pump portion 170 as shown in FIG. 4.

In other preferred embodiments, the control knob 212 on the relief valve and pump handle 174 are exterior to the body, but are supported, attached and integral to the hydraulic pump portion 170.

Figure 7:
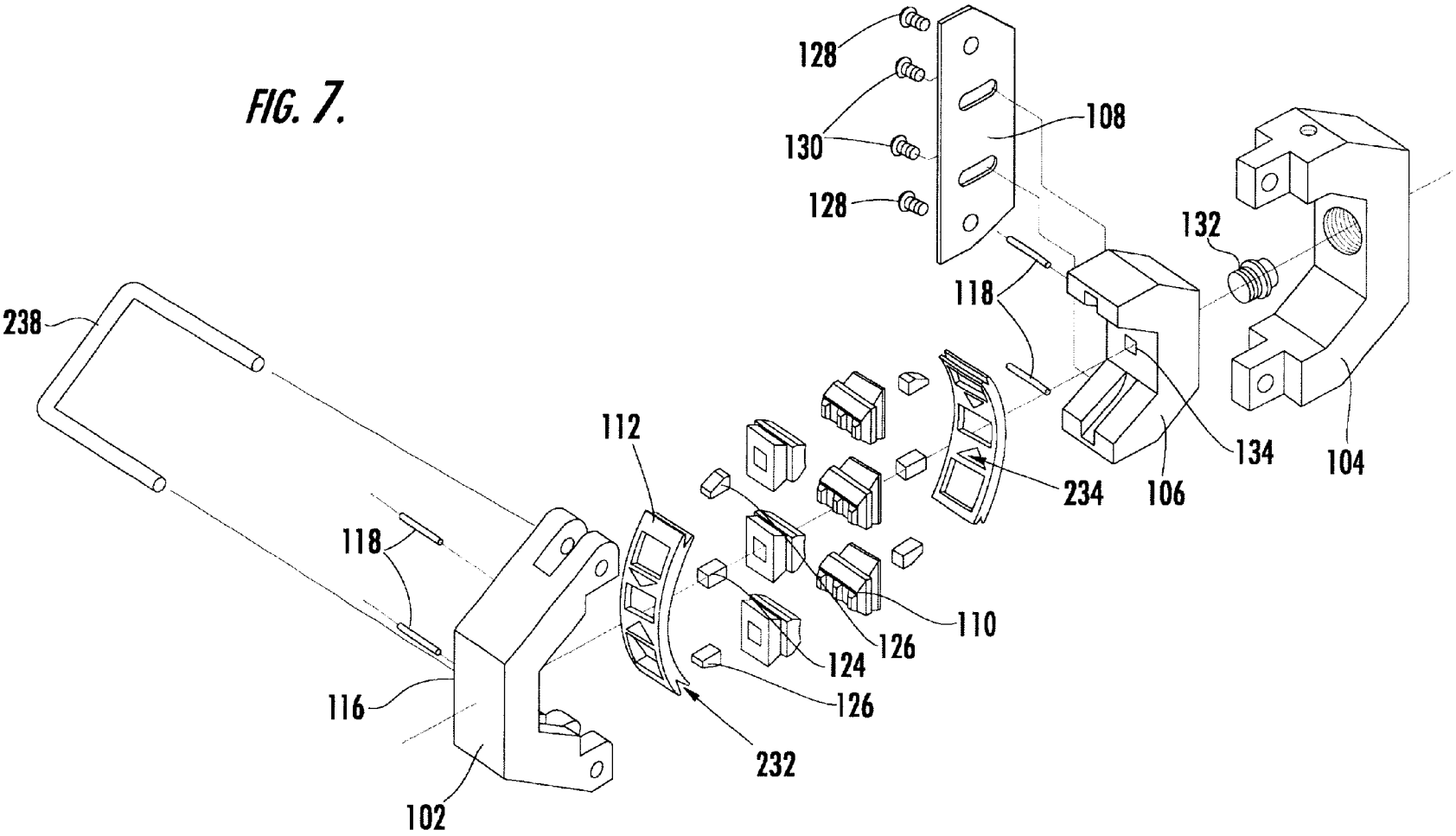
FIG. 7 is a view of the parts to the yoke and die members.
Figure 8:
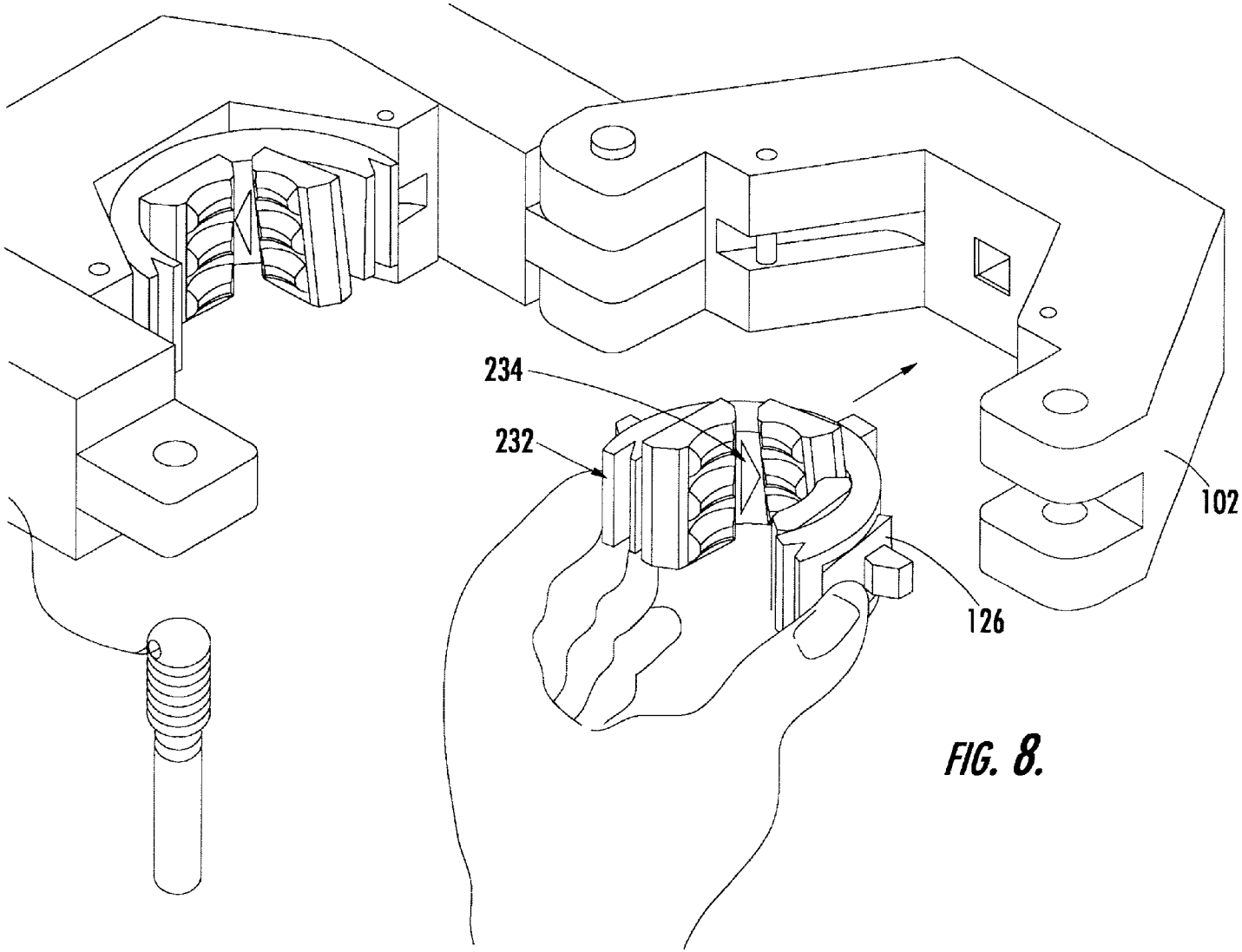
FIG. 8 is a schematic drawing of the removable crimping dies.

In a preferred embodiment of the present invention, the hydraulic pump portion 170 is attached to yoke by screwing the threaded body 142 to bottom yoke 104, FIGS. 2 and 7. A crimping piston 140 travels through threaded body 142 and transfers force to bottom die holder 106. The crimping piston 140 is attached to bottom die holder 106 by bottom die adapter 132 which is threaded onto bottom die holder 106 and coupled to crimping piston 140 by guide notch 220 as shown in FIGS. 5*c* and 5*d*.

In the present invention, the hydraulic pressure can be relieved by any methods known to those skilled in the art of hydraulics, such as, but not limited to relief valves. Many types of relief valves are known to those skilled in the art.

In one embodiment of the present invention, the hydraulic pump portion 170 comprises a relief valve 208 in order to release the hydraulic pressure after the crimping has been completed. Any relief valves known to those in the art of hydraulics can be used in the present invention to relieve the pressure. For example, but not by way of limitation, the relief valve can be manually operated, pneumatically operated or automatically operated based on hydraulic pressure.

In a preferred embodiment of the present invention, once the crimping process is completed, the crimped hose is retrieved by releasing pressure in frontal pressurized cylinder 216 through a relief valve 208 as shown in FIG. 6. The pressure in frontal pressurized cylinder 216 is released when valve nub 212 is turned counter-clockwise and the ball 218 is released from blocking passage 198. Oil reservoir 196 is also connected to frontal pressurized cylinder 216 through separate return passages 198 and 202 that are located in a plane perpendicular to the plane of intake passages 154, 156 and 158. The pressure valve unit consists of nub 212, valve stem 204, O-rings (two) 206 cap screw 210 and O-ring 224. Valve stem 204 is screwed into threads on cap 210 and is guided in the axial direction. Cap 210 also prevents valve stem 204 from being unscrewed out of passage. To close the valve, nub 212 is turned clockwise thereby forcing ball 218 onto passage 198. In this position oil can only flow from reservoir 196 to frontal pressurized cylinder 216 through cylindrical passages 154, 156 and 158.

The present invention has the advantage of expeditiously crimping a fitting to a hose. Preferably, a leak-proof double crimp is formed in the fitting for providing a leak-proof connection of the hose to the fitting. The present invention can be readily adjusted to accommodate various sized fitting and hoses. Different shaped crimps can be obtained by altering the shape of deflector rollers, which crimp the fitting.

Numerous modifications and alternative embodiments of the invention will be apparent to those skilled in the art in view of the foregoing description. Accordingly. this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claim, is reserved.

What is claimed is:

1. A hand-held portable crimping tool for securing a fitting to a hose comprising:

a hydraulic body having a crimping piston;

a yoke comprising a top yoke and a bottom yoke, wherein the bottom yoke is coupled to the hydraulic body and the top yoke is coupled to the bottom yoke;

a top die locator in communication with the top yoke;

a bottom die locator in communication with the bottom yoke;

crimping-dies for crimping the hose, said crimping-dies coupled to the bottom die locator and the top die locator; and, a guide foot and a corresponding guide hole for a particular crimping-die, the guide foot is comprised of a resilient material, wherein movement of the guide foot into the corresponding guide hole changes the relative position the particular crimping die when a crimping force is applied by the crimping-dies to the fitting;

wherein application of a linear crimping force applied by the crimping piston is transformed to a controlled non-linear crimping force as applied by the crimping-dies to the fitting.

2. The tool as recited in claim 1 wherein the linear crimping force by the crimping piston is transformed to at least a partial radial crimping force as applied by the crimping-dies to the fitting.

3. The tool as recited in claim 1 wherein the linear crimping force by the crimping piston is transformed to correspond to an essentially optimal crimping force for a particular fitting.

4. The tool as recited in claim 1 wherein the resilient material of the guide foot is comprised composite of layers and zones of material of resilient materials.

5. The tool as recited in claim 1 wherein the resilient material of the guide foot has at least one slot.

6. The tool as recited in claim 1 wherein the resilient material of the guide foot has at least one cutout.

7. The tool as recited in claim 1 wherein the linear crimping force by the crimping piston is transformed to at least a partial radial crimping force as applied by the crimping-dies to the fitting.

8. The tool as recited in claim 1 wherein the linear crimping force by the crimping piston is transformed to correspond to an essentially optimal crimping force for a particular fitting.

9. The tool as recited in claim 1 wherein the top yoke is pivotally coupled to the bottom yoke.

10. The tool as recited in claim 1 wherein the top yoke is coupled to the bottom yoke by a single removable coupling.

11. The tool as recited in claim 1 wherein the non-linear crimping force is a function of the linear crimping force.

12. A hand-held portable crimping tool for securing a fitting to a hose comprising:

a hydraulic body having a crimping piston;

a yoke comprising a top yoke and a bottom yoke, wherein the bottom yoke is coupled to the hydraulic body and the top yoke is coupled to the bottom yoke;

a top die locator comprised of a resilient material, the top die locator is in communication with the top yoke;

a bottom die locator in communication with the bottom yoke;

crimping-dies for crimping the hose, said crimping-dies coupled to the bottom die locator and the top die locator;

wherein application of a linear crimping force applied by the crimping piston is transformed to a controlled non-linear crimping force as applied by the crimping-dies to the fitting and the resilient material is comprised of composite layers and zones of material of resilient materials.

13. A hand-held portable crimping tool for securing a fitting to a hose comprising:

a hydraulic body having a crimping piston;

a yoke comprising a top yoke and a bottom yoke, wherein the bottom yoke is coupled to the hydraulic body and the top yoke is coupled to the bottom yoke;

a top die locator in communication with the top yoke;

a bottom die locator comprised of a resilient material, the bottom die locator is in communication with the bottom yoke;

crimping-dies for crimping the hose, said crimping-dies coupled to the bottom die locator and the top die locator;

wherein application of a linear crimping force applied by the crimping piston is transformed to a controlled non-linear crimping force as applied by the crimping-dies to the fitting and the resilient material is comprised of composite layers and zones of material of resilient materials.

* * * * *